US005849456A

United States Patent [19]

Matsumura et al.

[11] Patent Number: 5,849,456

[45] Date of Patent: Dec. 15, 1998

[54] TONER FOR DEVELOPING ELECTROSTATIC CHARGE IMAGE, PRODUCTION METHOD THEREOF, AND IMAGE FORMATION METHOD

[75] Inventors: Yasuo Matsumura; Manabu Serizawa; Masaaki Suwabe; Shuji Sato; Yasuo Kadokura, all of Minami-ashigara, Japan

[73] Assignee: Fuji Xerox Co., Ltd., Tokyo, Japan

[21] Appl. No.: 889,141

[22] Filed: Jul. 7, 1997

[30] Foreign Application Priority Data

Jul. 11, 1996 [JP] Japan ..... 8-182022

[51] Int. Cl.[6] ..... G03G 9/087

[52] U.S. Cl. ..... 430/137; 430/126

[58] Field of Search ..... 430/137, 106, 430/109, 110, 126

[56] References Cited

U.S. PATENT DOCUMENTS

| | | | |
|---|---|---|---|
| 5,079,125 | 1/1992 | Anno et al. | 430/110 |
| 5,387,489 | 2/1995 | Fuller et al. | 430/137 |
| 5,482,812 | 1/1996 | Hopper et al. | 430/137 |

FOREIGN PATENT DOCUMENTS

| | | |
|---|---|---|
| A-49-91231 | 8/1974 | Japan . |
| A-56-11461 | 2/1981 | Japan . |
| A-56-40868 | 4/1981 | Japan . |
| A-62-39879 | 2/1987 | Japan . |
| A-63-282752 | 11/1988 | Japan . |
| A-6-250439 | 9/1994 | Japan . |

*Primary Examiner*—John L. Goodrow
*Attorney, Agent, or Firm*—Oliff & Berridge, PLC

[57] ABSTRACT

The present invention provides a toner for developing an electrostatic charge image having excellent characteristics including a developing property, transfer property, fixing property, and cleaning property, and an efficient production method thereof. The present invention relates to a production method of a toner for developing an electrostatic charge image comprising: a first step of forming aggregative particles in a first dispersion including at least dispersed resin particles to prepare an aggregative particle dispersion, a second step of adding a fine particle dispersion containing dispersed fine particles into said aggregative particle dispersion and mixing therewith to form adhered particles having said fine particles adhering to said aggregative particles, and a third step of heating said adhered particles to be melted.

22 Claims, No Drawings

TONER FOR DEVELOPING ELECTROSTATIC CHARGE IMAGE, PRODUCTION METHOD THEREOF, AND IMAGE FORMATION METHOD

BACKGROUND OF THE INVENTION

1. Field of the Invention

The present invention relates to a toner for developing an electrostatic image used for the development of an electrostatic latent image formed in an electrophotography method or an electrostatic recording method with a developer and a production method thereof, an electrostatic charge image developer containing the toner for developing an electrostatic image, and an image formation method using the electrostatic charge image developer.

2. Description of the Related Art

Methods for visualizing image information via an electrostatic charge image, such as an electrophotography method, are widely used in various fields. In the electrophotography method, an electrostatic charge image is formed on a light-sensitive element via a charging process, an exposure process, etc. The electrostatic charge image is developed with a developer containing toner particles, and visualized via a transfer step, a fixing process, etc.

As the developer, two-component-type image developers containing toner particles and carrier particles, and one-component-type developers containing magnetic toner particles or nonmagnetic toner particles are known. Toner particles in the developer are usually produced in a kneading and pulverizing method. In the kneading and pulverizing method, a thermoplastic resin is melted and kneaded with a pigment, a charge controller, and a mold release agent such as a wax. After cooling, the melted and kneaded product is finely pulverized and classified to produce desired toner particles. In order to improve the flowability and cleaning property of the toner particles produced by the kneading and pulverizing method, inorganic and/or organic fine particles can be further added to the surface thereof as needed.

Toner particles produced in the kneading and pulverizing method usually have an amorphous shape without a homogeneous surface composition Although the shape and surface composition of toner particles change slightly depending upon the pulverizability of the used material and conditions of the pulverizing process, it is difficult to intentionally control these elements to a desired degree. In addition, in the case of toner particles produced in the kneading and pulverizing method with a material with a particularly high pulverizability, due to mechanical forces in the developing device such as shearing force, it is often the case that the particles are pulverized still more finely or the shape thereof is altered. As a consequence, problems occur in the case of the two-component-type developer, the pulverized toner particles adhere to the carrier surface so that the charge deterioration of the developer is accelerated, and in the case of the one-component-type developer, the particle size distribution is expanded so that the pulverized toner particles scatter or the developing property is lowered according to the change of the toner shape, resulting in a deteriorated image quality.

In a case in which the toner particles have an amorphous shape, there is a problem that, even though a flowability aid is added, the flowability is insufficient and the fine particles of the flowability aid are moved to the concave portions of the toner particles to be buried therein during operation due to mechanical force such as shearing force, and thus flowability decreases over time or the developing property, transfer property, and property, and cleaning property deteriorate. Furthermore, there is a problem that, by recycling the toner through recollection and cleaning treatment to return to the developer, it tends to deteriorate image quality. In order to prevent these problems, further increase of the amount of the flowability auxiliary agent can be considered; however, this involves problems in that generation of spots on the light-sensitive element and particle scattering of the flowability auxiliary agent occur.

On the other hand, in a case of a toner containing a mold release agent such as a wax, the mold release agent may be exposed on the toner particle surface depending upon the combination with a thermoplastic resin; Particularly in the case of a toner combining a resin applied with elasticity by a high molecular weight component not easily pulverized and a vulnerable wax such as polyethylene, polyethylene exposure on the toner particle surface is often observed. Although such a toner has an advantageous mold releasing property at fixing or cleaning of untransferred toner on the light-sensitive element, there is a problem since polyethylene on the surface of the toner particles easily fall off toner particles due to the mechanical force in the developing device such as shearing force and transfer to the developing roller, the light-sensitive element, the carrier, etc., causing dirt that decreases the reliability of the developer.

Under such circumstances, nowadays, as a means for producing a toner whose particle shape and the surface composition are intentionally controlled, an emulsion polymerization aggregation method is proposed in Japanese Patent Application Laid-Open (JP-A) Nos. 63-282752 and 6-250439. The emulsion polymerization aggregation method is for obtaining toner particles by preparing a resin dispersion by emulsion polymerization and a colorant dispersion where a colorant is dispersed in a solvent, mixing for forming aggregative particles corresponding to the toner particle size, and heating for fusing. According to the emulsion polymerization aggregation method, the toner shape can be optionally controlled from amorphous to spherical by the selection of the heating temperature condition.

However, in the case of the emulsion polymerization aggregation method, since aggregative particles in a homogeneous mixing state are fused, the composition of the toner is homogeneous from the inside to the surface, and thus it is difficult to intentionally control the structure and composition of the toner particle surface. Particularly in the case the aggregative particles contain a mold release agent, the mold release agent exists on the toner particle surface after fusing so that filming generation and burial of the external additive used for the sake of flowability inside the toner may occur.

In order to maintain and pursue stable toner performance under various mechanical stresses in an electrophotography process, it is necessary to constrain the exposure of a mold release agent on the toner particle surface, to improve the surface hardness of the toner particle, and to further improve the smoothness of the toner particle surface. Although the mold release agent may cause various problems if it is exposed on the toner particle surface, it is preferable that it be near the toner particle surface in consideration of the toner performance at fixing.

Recently, owing to the need for higher image quality, particularly in color image formation, toners of a smaller size have been developed for realizing finer images. However, with conventional toner particle distribution, merely with a smaller size, it is difficult to simultaneously realize both high image quality and high reliability due to significant problems of dirt on a carrier or a light-sensitive element and toner scattering due to finer toner particles. In order to realize high image quality and high reliability at the same time, a sharper toner particle distribution and a smaller particle size are needed.

SUMMARY OF THE INVENTION

An object of the present invention is to solve the various conventional problems by providing the following to control the structure and composition of toner particles from the surface to the inside:

1. a toner for developing an electrostatic charge image having excellent characteristics including a developing property, transfer property, fixing property, and cleaning property;
2. a toner for developing an electrostatic charge image having high reliability, capable of stably maintaining and pursuing the above-mentioned characteristics;
3. a production method of a toner for developing an electrostatic charge image capable of easily and conveniently producing the toner for developing an electrostatic charge image having the excellent above-mentioned characteristics;
4. a two-component-type electrostatic charge image developer having a high transfer efficiency, low toner consumption, and long life;
5. an image formation method capable of easily and conveniently forming a full-color image having high image quality and high reliability;
6. an electrostatic charge image developer and an image formation method capable of obtaining a high image quality in a so-called cleanerless system without a cleaning mechanism; and
7. an electrostatic charge image developer and an image formation method capable of adjusting to a so-called toner recycling system where a toner collected from a cleaner is reused to obtain a high image quality.

A first means for solving the above-mentioned problems is a production method of a toner for developing an electrostatic charge image comprising a first step in which first aggregative particle dispersion is prepared by forming aggregative particles in a dispersion including at least resin particles dispersed therein, a second step in which adhered particles are formed by adding a fine particle dispersion containing dispersed fine particles into the first aggregative particle dispersion and mixing therewith so as to have the fine particles adhere to the aggregative particles, and a third step in which the adhered particles are heated so as to be fused.

In the above-mentioned production method of a toner for developing an electrostatic charge image, it is preferable that the dispersion contain a dispersed colorant. It is preferable that the fine particles comprise fine particles for a resin, inorganic particles, colorant particles, or mold release agent particles. It is preferable that the resin particles have an average particle size of 1 $\mu$m or less. It is preferable that the fine particles have an average particle size of 1 $\mu$m or less, and the volume thereof is 50% or less based on the volume of the toner particles for developing an electrostatic charge image. An embodiment in which the fine particle dispersion is divided into two or more, and then added and mixed is preferable.

An embodiment in which the second step is conducted repeatedly is preferable. It is preferable that the second step be a step in which adhered particles are prepared by adding and mixing mold release agent fine particles in an aggregative particle dispersion to form adhered particles, and further adding and mixing a resin-containing fine particle dispersion to the adhered particles for further adhering the resin-containing particles. It is preferable that the second step be a step in which adhered particles are prepared by adding and mixing colorant fine particles into an aggregative particle dispersion to form adhered particles, and further adding a resin-containing fine particle dispersion to the adhered particles and mixing for further adhering the resin-containing particles. It is preferable that the second step be a step in which adhered particles are prepared by adding and mixing resin-containing fine particles into an aggregative particle dispersion to form adhered particles, and further adding and mixing an inorganic fine particle dispersion to the adhered particles for further adhering the inorganic fine particles.

An embodiment in which the resin-containing fine particles comprise complex fine particles containing a resin and a colorant is preferable. Further, an embodiment in which heating of the third step is conducted at the temperature of the glass transitional point of the resin or higher after adding and mixing is preferable.

A second means for solving the above-mentioned problems is a toner for developing an electrostatic charge image produced by the above-mentioned production method of a toner for developing an electrostatic charge image.

A third means for solving the above-mentioned problems is an image formation method comprising the steps of forming an electrostatic latent image on an electrostatic latent image holding member, developing the electrostatic latent image by a developer layer on a developer carrying member to form a toner image, and transferring the toner image on a transfer body, wherein the developer layer comprises the above-mentioned electrostatic charge image developer.

In the above-mentioned image formation method, an embodiment further comprising a cleaning step in which an excess amount of the toner for developing an electrostatic charge image is collected during forming toner image, and a recycling step in which the toner for developing an electrostatic charge image collected in the above-mentioned cleaning step is transferred to the developer layer, is preferable.

According to the present invention, the above-mentioned conventional problems can be solved.

Furthermore, according to the present invention, a toner for developing an electrostatic charge image having excellent properties including a developing property, transfer property, fixing property, and cleaning property, capable of stably maintaining and pursuing the properties with a high reliability can be provided. Further, according to the present invention, a production method of a toner for developing an electrostatic charge image capable of producing the above-mentioned toner for developing an electrostatic charge image having excellent properties can be provided easily and conveniently. Moreover, according to the present invention, a two-component-type electrostatic charge image developer having a high transfer efficiency with low toner consumption amount and a long life can be provided. In addition, according to the present invention, an image formation method capable of forming a full-color image with high image quality and high reliability can be provided easily and conveniently.

An electrostatic charge image developer and an image formation method of the present invention are highly suitable both for a cleanerless system and for a toner recycle system, enabling a high image quality to be easily obtained.

DESCRIPTION OF THE PREFERRED EMBODIMENTS

Production method of a toner for developing an electrostatic charge image:

A production method of a toner for developing an electrostatic charge image of the present invention comprises a first step, a second step, and a third step.

First step:

The first step comprises a step in which an aggregative particle dispersion is prepared by forming aggregative particles in a dispersion (hereinafter, the first step may be referred to as an "aggregation step").

The dispersion comprises at least dispersed resin particles.

The resin particles comprise particles made from a resin.

As an example of the resin, a thermoplastic binder resin may be used. Concrete examples include homopolymers or copolymers of styrenes (styrene-containing resin), such as styrene, parachloro styrene, and α-methyl styrene; homopolymers or copolymers of esters (vinyl-containing resin) having a vinyl group, such as methyl acrylate, ethyl acrylate, n-propyl acrylate, n-butyl acrylate, lauryl acrylate, 2-ethyl hexyl acrylate, methyl methacrylate, ethyl methacrylate, n-propyl methacrylate, lauryl methacrylate, and 2-ethyl hexyl methacrylate; homopolyers or copolymers of vinyl nitriles (vinyl-containing resin), such as acrylonitrile, and methacrylonitrile; homopolymers or copolymers of vinyl ethers (vinyl-containing resin), such as vinyl methyl ether, and vinyl isobutyl ether; homopolymers or copolymers of vinyl ketones (vinyl-containing resin), such as vinyl methyl ketone, vinyl ethyl ketone, and vinyl isopropenyl ketone; homopolymers or copolymers of olefins (olefin-containing resin), such as ethylene, propylene, butadiene, and isoprene; and nonvinyl condensation-containing resins, such as an epoxy resin, a polyester resin, a polyurethane resin, polyamide resin, a cellulose resin, and a polyether resin, and graft copolymers of nonvinyl condensation-containing resins and a vinyl-containing monomer. These resins can be used alone or in a combination of two or more.

Among these resins, styrene-containing resins, vinyl-containing resins, polyester resins, and olefin-containing resins are preferable. Particularly preferable are copolymers of styrene and n-butyl acrylate, copolymers of n-butyl acrylate and bisphenol A/fumaric acid, and copolymers of styrene and olefin.

An average particle size of the resin particles is, in general, 1 μm or less, and preferably 0.01 to 1 μm. An average resin particle size exceeding 1 μm causes a broader particle size distribution of a toner for developing an electrostatic charge image finally obtained or generates free radical particles, and thus easily causes deterioration of performance or reliability. On the other hand, an average particle size within the above-mentioned range eliminates the above-mentioned problems, toners can be spread more evenly so that the state of dispersion in the toners is improved, and thus it is advantageous in that irregular performance or reliability is alleviated. The average particle size may be measured with a Coulter counter.

In a case a colorant fine particle dispersion is not used as a fine particle dispersion in the second step of the present invention described hereinafter, it is further necessary to have a colorant dispersed in the above-mentioned dispersion. In this case, a colorant may be dispersed in the resin particle dispersion, or a colorant dispersion may be mixed with the resin particle dispersion.

Examples of the colorant include pigments, such as carbon black, chrome yellow, hanza yellow, bendizine yellow, threne yellow, quinoline yellow, permanent orange GTR, pyrazolone orange, vulcan orange, watchung red, permanent red, brilliant carmine 3B, brilliant carmine 6B, pyrazolone red, lithol red, rhodamine lake B, lake red C, rose iron oxide red, aniline blue, ultra marine blue, methylene blue chloride, phthalocyanine blue, phthalocyanine green, and malachite green oxalate; and dyes, such as acridine type, xanthene type, azo type, benzoquinone type, adine type, anthraquinone type, dioxadine type, thiazine type, azomethine type, indigo type, thioindigo type, phthalocyanine type, aniline black type, polymethine type, triphenyl methane type, diphenyl methane type, thiazine type, thiazole type, and xanthene type. These colorants may be used alone or in combination of two or more.

An average particle size of the colorant is, in general, 1 μm or less, and preferably 0.01 to 1 μm. An average colorant particle size exceeding 1 μm causes a broader particle size distribution of a toner for developing an electrostatic charge image finally obtained or generates free radical particles, and thus easily causes deterioration of performance or reliability. On the other hand, an average particle size within the above-mentioned range eliminates the above-mentioned problems, toners can be spread more evenly so that the state of dispersion in the toners is improved, and thus it is advantageous in that irregular performance or reliability is alleviated. The average particle size may be measured with a Coulter counter.

If both colorant and resin particles are used in the dispersion, the combination is not specifically limited and thus it can be selected optionally according to the purpose.

In the present invention, other components such as a mold release agent, an internal additive, a charge controller, inorganic particles, a lubricant, and an abrasive may be dispersed in the above-mentioned dispersion according to the purpose. In this case, the other particles may be dispersed in the resin particle dispersion, or a dispersion of other particles may be mixed with the resin particle dispersion.

Examples of the mold release agent include low-molecular-weight polyolefins, such as polyethylene, polypropylene, and polybutene; silicones having a softening point induced by heating; aliphatic amides, such as amide oleate, amide erucate, amide ricinolate, and amide stearate; plant waxes, such as carnauba wax, rice wax, canderira wax, tree wax, and jojoba oil; animal wax, such as beeswax; ore/oil waxes, such as montan wax, ozokerite, ceresin, paraffin wax, microcrystalline wax, and Fischer Tropsch wax; and denatured products thereof.

These waxes can be easily processed to be fine particles of 1 μm or less by dispersing in water with a polymer electrolyte, such as an ionic surfactant, a polymeric acid, and a polymeric base, heating to the melting point or higher, and treating with a homogenizer capable of applying a strong shearing force or a pressure-discharge-type disperser.

Examples of interior additive include metals, such as ferrite, magnetite, reduced iron, cobalt, nickel, and manganese, alloys, and magnetic substances such as a compound containing metals.

Examples of the charge controller include a quaternary ammonium salt compound, a nigrosine-containing compound, dyes comprising a complex of aluminum, iron or chrome, and a triphenyl methane-containing pigment. It is preferable that a charge controlling agent of the present invention comprise a material not liable to dissolve in water in consideration of control of the ion strength, which influences stability upon aggregation or fusion, and reduction of waste water pollution.

Examples of inorganic particles include any particle usually applicable as an external additive of the toner surface, such as silica, alumina, titania, calcium carbonate, magnesium carbonate, calcium phosphate, cerium oxide, and the like.

Examples of the lubricant include aliphatic amides, such as ethylene bisstearylamide, and amide oleate, and aliphatic metal salts, such as zinc stearate, calcium stearate, and the like.

Examples of the abrasive include silica, alumina, cerium oxide, and the like.

An average particle size of other components is, in general, 1 μm or less, and preferably 0.01 to 1 μm. An average particle size of other component exceeding 1 μm causes a broader particle size distribution of a toner for developing an electrostatic charge image finally obtained or generates free radical particles, and thus easily causes deterioration of performance or reliability. On the other hand, an average particle size within the above-mentioned range eliminates the above-mentioned problems, toners can be spread more evenly so that the state of dispersion in the toners is improved, and thus it is advantageous in that irregular performance or reliability is alleviated. The average particle size may be measured with a Coulter counter.

As the dispersion medium for the above-mentioned dispersion, an aqueous medium can be presented. Examples of the aqueous medium include water, such as distilled water and ion exchange water, and alcohols. These can be used alone or in combination of two or more.

In the present invention, it is preferable that the aqueous medium be added and mixed with a surfactant.

Examples of the surfactant include anionic surfactants such as sulfate ester salt type, sulfonate type, phosphate type, and soap type; cationic surfactants such as amine salt type and quartenary ammonium salt type; nonionic type surfactants such as polyethylene glycol type, alkyl phenol ethylene oxide adduct type, and polyhydric alcohol type. Among these examples, anionic surfactants and cationic type surfactants are preferable. It is preferable that the nonionic type surfactants are used in combination with the anionic surfactant or the cationic surfactant. The surfactants may be used alone or in combination of two or more.

Examples of anionic surfactants include sodium dodecyl benzene sulfonate, sodium dodecyl sulfate, sodium alkyl naphthalene sulfonate, and sodium dialkyl sulfosuccinate. Examples of cationic surfactants include alkyl benzene dimethyl ammonium chloride, alkyl trimethyl ammonium chloride, and distearyl ammonium chloride.

Among these examples, ionic surfactants such as anionic surfactants and cationic surfactants are preferable.

The amount of resin particles in the dispersion is 40% or less by weight in the aggregative particle dispersion where the aggregative particles are formed, and is preferably 2 to 20% by weight.

If the colorant or magnetic substance is dispersed in the dispersion, the amount of the colorant in the dispersion is 50% or less by weight based on the aggregative particle dispersion where the aggregative particles are formed, and is preferably 2 to 40% by weight.

Furthermore, if other components are dispersed in the dispersion, the amount of other components is acceptable so long as it does not adversely affect the objects of the present invention. In general, it is quite small amount, namely, 0.01 to 5% by weight based on the aggregative particle dispersion where the aggregative particles are formed, and is preferably 0.5 to 2% by weight. If the amount is outside the above-mentioned range, properties may be deteriorated such as insufficient effect of dispersing the other particles or a wider particle size distribution.

The dispersion comprising at least dispersed resin particles can be prepared as follows:

If the resin of the resin particle comprises a homopolymer or a copolymer of a vinyl-containing monomer (vinyl-containing resin), such as ethers having vinyl nitriles, vinyl ethers, and vinyl ketones, a dispersion where resin particles comprising a homopolymer or a copolymer of a vinyl containing monomer (vinyl-containing resin) dispersed in a first ionic-type surfactant by the emulsion polymerization or the seed polymerization of the vinyl type monomer in the first ionic-type surfactant.

If the resin particles comprises a resin other than the vinyl-type monomers and the resin dissolves in an oil-type solvent having a comparatively low solubility to water, the resin is dissolved in the oil type solvent and the solution is dispersed in water as fine particles with a first ionic surfactant or a polymer electrolyte by a disperser such as a homogenizer, and the oil-type solvent is evaporated by heating or reducing pressure so as to obtain a dispersion where the resin particles of a resin other than a vinyl-type resin are dispersed in a first ionic surfactant.

The means for dispersion is not specifically limited, and examples thereof include conventionally known dispersers, such as a rotation shearing homogenizer, a ball mill, a sand mill, and a dyno mill, which have media.

The aggregative particles are prepared as follows:

To a first dispersion comprising an aqueous medium added and mixed with a second ionic surfactant and at least the resin particles dispersed therein, a second ionic surfactant (I) having the polarity opposite to the first ionic surfactant, an aqueous medium (II) added and mixed therewith, or a second dispersion containing the aqueous medium (III) is mixed. By stirring the mixture liquid, according to the function of the first ionic surfactant, the resin particles are aggregated in the dispersion to form aggregative particles of the resin particles to obtain an aggregative particle dispersion.

It is preferable that the mixing procedure is conducted at a temperature of the glass transition point or lower of the resin contained in the mixture. By conducting the mixing procedure at this temperature, aggregation can take place stably.

The second dispersion comprises a dispersion where the resin particles, the colorant, and/or the other particles dispersed therein. The stirring procedure can be conducted with conventionally known stirring devices, homogenizers, and mixers.

In (I) or (II) above, aggregative particles of the resin particles dispersed in the first dispersion are formed.

The amount of the resin particles in the first dispersion is, in general, 5 to 60% by weight, and is preferably 10 to 40% by weight. The amount of the aggregative particles in the aggregative particle dispersion upon forming the aggregative particles is, in general, 40% by weight or less.

In (III) above, if the particles dispersed in the second dispersion are the resin particles, the aggregative particles of the resin particles dispersed in the first dispersion are formed. On the other hand, if the particles dispersed in the second dispersion are the colorant and/or the other particles, aggregative particles of these and the resin particles dispersed in the first dispersion of hetero aggregation are formed. Furthermore, if the particles dispersed in the second dispersion are resin particles, the colorant, and/or the other particles, aggregative particles of the resin particles dispersed in the first dispersion are formed.

In this case, the amount of the resin particles in the first dispersion is, in general, 5 to 60% by weight, preferably 10 to 40% by weight. The amount of the resin particles, the colorant, and/or the other particles in the second dispersion is, in general, 5 to 60% by weight, preferably 10 to 40% by weight. If the amount is outside the range, the particle size distribution becomes wider and the properties may deteriorate. The amount of aggregative particles in the aggregative particle dispersion at aggregative particle formation is, in general, 40% or less by weight.

If the aggregative particles or adhered particles are formed, it is preferable to have the opposite polarities in the ionic surfactant contained in the dispersion to be added and the ionic surfactant contained in the dispersion to added, and change the balance of the polarities.

An average particle size of the aggregative particles to be formed is not specifically limited, and, in general, is controlled so as to be about the same as the average particle size of the toner for developing an electrostatic charge image to be obtained. The control can be easily conducted by optionally setting or changing the temperature and the conditions of stirring and mixing.

By the first step heretofore mentioned, aggregative particles having an average particle size about the same as the average particle size of the toner for developing an electrostatic charge image are formed, and the aggregative particle dispersion where the aggregative particles are dispersed is prepared. The aggregative particles may be referred to as "mother particles" in the present invention.

Second step:

The above-mentioned second step is a step in which adhered particles are formed by adding and mixing a fine particle dispersion to the aggregative particle dispersion so that the fine particles adhere to the aggregative particles (hereinafter the second step may be referred to as the "adhesion step".

Examples of the fine particles include resin-containing fine particles, inorganic fine particles, colorant fine particles, mold release agent fine particles, interior additive fine particles, and charge controller fine particles.

The above-mentioned resin-containing fine particles are fine particles containing at least one from the above-mentioned resins.

The above-mentioned resin-containing fine particles may be resin fine particles comprising at least one from the above-mentioned resins by 100% by weight, or complex fine particles comprising at least one from the above-mentioned resins and at least one from the above-mentioned colorants, inorganic particles, mold release agents, interior additives and charge controllers. In the present invention, among the above-mentioned complex fine particles, complex (resin/colorant) fine particles containing at least one from the above-mentioned resins and at least one from the above-mentioned colorants are preferable.

The inorganic fine particles are fine particles containing at least one from the above-mentioned inorganic particles. The colorant fine particles are fine particles containing at least one from the above-mentioned colorants. The mold release agent fine particles are fine particles containing at least one from the above-mentioned mold release agents. The interior additive fine particles are fine particles containing at least one from the above-mentioned interior additives. The charge controller fine particles are fine particles containing at least one from the above-mentioned charge controllers.

Among these fine particles, resin-containing fine particles, inorganic fine particles, colorant fine particles, or mold release agent fine particles are preferable.

The above-mentioned resin-containing fine particles are preferably used in producing a toner for developing a multicolor electrostatic charge image. By using the above-mentioned resin-containing fine particles, since a layer of the resin-containing fine particles is coated and formed on the surface of the aggregative particles of the resin particles and the colorant, the effect of the charge behavior of the colorant can be minimized, and thus the difference in the charge properties according to the type of colorant can be restrained. By selecting a resin having a glass transition point as high as the resin of the above-mentioned resin-containing fine particles, a toner for developing an electrostatic charge image capable of achieving both heat preservation property and fixing property can be produced.

By using the above-mentioned resin-containing fine particles (complex particles of a resin and a colorant) and adhering them to the above-mentioned aggregative particles, a toner for developing an electrostatic charge image having a more complicated hierarchial structure can be produced. By using the above-mentioned inorganic fine particles and adhering them to the above-mentioned aggregative particles, a toner for developing an electrostatic charge image having a capsulated structure by the inorganic fine particle layer after fusing of the third step can be produced.

An average particle size of the fine particles is, in general, 1 $\mu$m or less, and preferably 0.01 to 1 $\mu$m. An average particle size of the resin particles larger than 1 $\mu$m causes a broader particle size distribution of a toner for developing an electrostatic charge image finally obtained or generates free radical particles, and thus it easily causes deterioration of performance or reliability. On the other hand, an average particle size within the above-mentioned range eliminates the above-mentioned problems, and has the advantage of forming the layer structure by the fine particles. The average particle size may be measured with a Coulter counter.

The volume of the above-mentioned fine particles depends upon the volume percentage of the toner for developing an electrostatic charge image to be obtained, and it is preferably 50% or less of the volume of the toner for developing an electrostatic charge image to be obtained. If the volume of the fine particles exceeds 50% of the volume of the toner for developing an electrostatic charge image to be obtained, the fine particles do not adhere to the adhered particles or do not aggregate so that new aggregative particles of the fine particles are formed to cause significant change in the composition distribution or the particle size distribution of the toner for developing an electrostatic charge image to be obtained, and thus desired properties may not be obtained.

In the fine particle dispersion, one type of these fine particles may be dispersed alone or can be dispersed in a combination of two or more. In the latter case, combinations of the fine particles are not specifically limited, and can be optionally selected according to the purpose.

As a dispersion medium in the fine particle dispersion, the above-mentioned aqueous medium can be presented. In the present invention, it is preferable that at least one from the above-mentioned surfactants is added and mixed with the above-mentioned aqueous medium.

The amount of the fine particles in the fine particle dispersion is, in general, 5 to 60% by weight, preferably 10 to 40% by weight. If the amount is outside the above-mentioned range, the structure and the composition of the toner for developing an electrostatic charge image from the inside to the surface may not be sufficiently controlled. The amount of the aggregative particles in the aggregative particle dispersion at the time of the aggregative particle formation is, in general, 40% or less by weight.

The above-mentioned fine particle dispersion can be prepared by dispersing the above-mentioned fine particles to an aqueous medium added and mixed with an ionic surfactant.

The fine particle dispersion comprising the above-mentioned complex fine particles are prepared by dissolving at least one from the above-mentioned resins and at least one from the above-mentioned pigments in the above-mentioned solvent, and dispersing the solution in water as fine particles with an ionic surfactant or a polymer electrolyte with a disperser such as a homogenizer, and eliminating the solvent by evaporating by heating or reducing pressure. Furthermore, it is prepared by mechanical shearing or electric adsorption or fixation on the surface of latex produced in the emulsion polymerization or the seed polymerization.

In the second step, adhered particles are formed by adding and mixing the fine particle dispersion in the aggregative particle dispersion prepared in the first step and adhering the fine particles on the aggregative particles. Since the fine particles are added to the aggregative particles, the fine particles may be referred to as "added particles" in the present invention.

The adding and mixing method is not specifically limited, and thus the procedure can be conducted gradually and continuously or can be conducted in stages divided in a plurality of times. By adding and mixing the fine particles (added particles), generation of minute particles can be suppressed, and thus a sharp particle distribution of the toner for developing an electrostatic charge image to be obtained can be ensured.

By conducting the adding and mixing procedure in stages divided in a plurality of times, layers of the above-mentioned fine particles are laminated on the surface of the above-mentioned aggregative particles in stages, and thus structure change or composition gradient can be provided from the inside to the outside of the particles of the toner for developing an electrostatic charge image. Therefore, surface hardness of the particles can be improved and the particle size distribution can be maintained at fusing in the third step and the change thereof can be restricted. Besides, the addition of a stabilizing agent such as a surfactant and a base or an acid for improving the stability at fusing is not required, or the addition amount thereof can be curbed to the minimum level, and thus it is preferable in that cost reduction and quality improvement can be achieved.

Conditions of adhering the above-mentioned fine particles on the above-mentioned aggregative particles are as follows:

The temperature of the glass transition point of the resin of the resin particles in the first step or lower, and about room temperature is preferable. By heating at the temperature of the glass transition point or lower, the above-mentioned aggregative particles and the above-mentioned fine particles are easily adhered, and the resulting adhered particles to be formed are easily stabilized.

Although the treatment time depends upon the above-mentioned temperature and thus cannot be strictly defined, it is, in general, 5 minutes to 2 hours.

In the above-mentioned adhesion, the dispersion containing the above-mentioned aggregative particles and the above-mentioned fine particles may be left standing or may be stirred gently with a mixer. The latter case is more advantageous in that homogeneous adhered particles can be formed easily.

In the present invention, the number of times for the second step is conducted may be one or a plurality of times. For one time, only one layer of the above-mentioned fine particles (added particles) is formed on the surface of the above-mentioned aggregative particles, whereas in the latter case, two or more layers of the above-mentioned fine particles (added particles) are formed successively on the surface of the above-mentioned aggregative particles. Therefore, the latter case is advantageous in that a toner for developing an electrostatic charge image having a complicated and precise hierarchial structure so that a desired function can be provided for the toner for developing an electrostatic charge image.

If the second step is conducted for a plurality of times, any combination of the fine particles to be adhered first and the fine particles to be adhered in the later stages can be used, and can be optionally selected according to the application of the toner for developing an electrostatic charge image and the purpose.

To the above-mentioned aggregative particles, a combination of adhering the above-mentioned mold release agent fine particles and the above-mentioned resin-containing fine particles, in this sequence, a combination of adhering the above-mentioned colorant fine particles and the above-mentioned resin-containing fine particles in this sequence, a combination of the above-mentioned resin-containing fine particles and the above-mentioned inorganic fine particles in this sequence, and a combination of the above-mentioned mold release agent fine particles and the above-mentioned inorganic fine particles in this sequence are preferable.

In the case of a combination of adhering the above-mentioned mold release agent fine particles and the above-mentioned resin-containing fine particles in this sequence, since a layer of the above-mentioned resin-containing fine particles exists on the outermost surface of the toner particles for developing an electrostatic charge image, the above-mentioned mold release agent fine particles exist in the vicinity of the surface of the toner particles for developing an electrostatic charge image without being exposed on the surface of the particles. Accordingly, it is possible to effectively operate the mold release agent fine particles during fixing while restraining the exposure of the above-mentioned mold release agent fine particles.

In the case of a combination of adhering the above-mentioned colorant fine particles and the above-mentioned resin-containing fine particles in this sequence, since a layer of the above-mentioned resin-containing fine particles exists on the outermost surface of the toner particles for developing an electrostatic charge image, the above-mentioned colorant fine particles are near the surface of the toner particles for developing an electrostatic charge image without being exposed on the surface of the particles. Accordingly, it is possible to prevent fall-off of the colorant fine particles from the surface of the toner particles for developing an electrostatic charge image.

In the case of a combination of adhering the above-mentioned resin-containing fine particles and the above-mentioned inorganic fine particles in this sequence, since a layer of the above-mentioned inorganic fine particles is on the outermost surface of the toner particles for developing an electrostatic charge image, a toner for developing an electrostatic charge image having a more capsulated structure owing to the layer of the inorganic fine particles can be produced.

As combinations other than the above-mentioned, for example, by adopting a combination of adhering a mold release agent particle dispersion and resin-containing fine particles or inorganic fine particles with a high hardness in this sequence, a hard shell can be formed on the outermost surface of the toner for developing an electrostatic charge image.

If the second step is conducted for a plurality of times, it is preferable to heat the dispersion containing the above-mentioned fine particles and the above-mentioned aggregative particles at a temperature of the glass transition point or less of the resin of the resin particles in the first step whenever the above-mentioned fine particles are added and mixed, and it is more preferable to increase the heating temperature stepwise. It is advantageous in that generation of free radical particles can be restrained.

The above-mentioned second step(s) can produce adhered particles formed by adhering the above-mentioned fine particles on the aggregative particles prepared in the first step. If the second step is repeated, adhered particles where the above-mentioned fine particles are adhered for the plurality of times on the aggregative particles prepared in the first step are formed. Accordingly, by adhering fine particles optionally selected to the above-mentioned aggregative particles in the second step, a toner for developing an electrostatic charge image having desired properties can be freely designed and produced.

Third step:

The above-mentioned third step is a step in which the above-mentioned adhered particles are heated and fused (hereinafter the third step may be referred to as a "fusing process").

A temperature for heating may be from the glass transition point temperature of the resin contained in the adhered particles to the decomposition temperature of the resin. Therefore, the above-mentioned heating temperature varies depending upon the type of resin of the above-mentioned resin particles, and thus cannot be defined as a whole. However, it is, in general, from the glass transition point temperature of the resin contained in the adhered particles to 180° C.

The heating procedure can be conducted with a conventionally known heating device or equipment.

As a duration of the above-mentioned fusion, a short duration may be sufficient if the above-mentioned heating temperature is high, and a long duration is necessary if the above-mentioned heating temperature is low. That is, since the above-mentioned heating duration depends upon the above-mentioned heating temperature, it cannot be defined as a whole; however, it is, in general, from 30 minutes to 10 hours.

In the present invention, it is possible to wash or dry a toner for developing an electrostatic charge image obtained after finishing the third step in optional conditions. It is also possible to add inorganic particles such as silica, alumina, titania, and calcium carbonate or resin particles such as a vinyl-containing resin, a polyester resin, and a silicone resin to the surface of the obtained toner for developing an electrostatic charge image while applying a shearing force in the dry state. These inorganic particles and the resin particles function as an external additive of the flowability auxiliary and the cleaning auxiliary.

The above-mentioned third step, wherein the adhered particles prepared in the second step are fused with the state where the above-mentioned fine particles (added particles) are adhered to the surface of the above-mentioned aggregative particles (mother particles), can produce a toner for developing an electrostatic charge image.

Toner for developing an electrostatic charge image:

A toner for developing an electrostatic charge image of the present invention is obtained by the above-mentioned production method of a toner for developing an electrostatic charge image of the present invention.

The above-mentioned toner for developing an electrostatic charge image has a structure with the above-mentioned aggregative particles as the core particles having the surface thereof coated with the above-mentioned fine particle layer. The above-mentioned fine particle layer may comprise one layer or two or more layers. The number thereof is the same as the number of the times of conducting the above-mentioned second step(s).

Since the above-mentioned toner for developing an electrostatic charge image has a structure where the composition and physical properties change from the inside to the surface continuously or discontinuously, and furthermore, the change is controlled in a desired range, excellent characteristics including the developing property, transfer property, fixing property, and cleaning property are provided. Moreover, since the above-mentioned characteristics are pursued and maintained stably, it is highly reliable.

Since the above-mentioned toner for developing and electrostatic charge image is produced in the above-mentioned production method of a toner for developing an electrostatic charge image of the present invention, unlike being produced in a kneading and pulverizing method, a small average particle size can be provided with a sharp particle distribution.

The above-mentioned average particle size is preferably 2 to 9 $\mu$m, and more preferably 3 to 8 $\mu$m. An average particle size smaller than 2 $\mu$m may easily cause insufficient charge property to decline the developing property, on the other hand, an average particle size larger than 9 $\mu$m may worsen the resolution property of an image.

As an index for the above-mentioned particle size distribution, using D16 and D84 of the cumulative distribution, a volume GSD (volume GSD=(volume D84/volume D16)$^{0.5}$) or a numerical GSD (numerical GSD=(numerical D84/numerical D16)$^{0.5}$) can be used easily and conveniently. The above-mentioned volume GSD is preferably 1.30 or less, and more preferably 1.27 or less.

If the above-mentioned volume GSD exceeds 1.30, the developing property may deteriorate over time according to the selected development.

Electrostatic charge image developer:

An electrostatic charge image developer of the present invention comprises a toner for developing an electrostatic charge image of the present invention and a carrier.

The above-mentioned carrier is not specifically limited, and conventionally-known carriers can be used. Examples thereof include the carriers disclosed in JP-A Nos. 62-39879 and 56-11461.

The mixing ratio of a toner for developing an electrostatic charge image of the present invention and a carrier in the above-mentioned electrostatic charge image developer is not specifically limited and can be selected optionally according to the purpose.

Image formation method:

An image formation method of the present invention comprises an electrostatic latent image formation step, a toner image formation step, and a transfer step. The above-mentioned steps are general steps disclosed in JP-A Nos. 56-40868 and 49-91231. An image formation method of the present invention can be implemented in conventionally-known image formation devices such as copy machines and facsimiles.

The above-mentioned electrostatic latent image formation step is a step in which an electrostatic latent image is formed on an electrostatic latent image holding member. The above-mentioned toner image formation step is a step in which the above-mentioned electrostatic latent image is developed by a developer layer on a developer carrying member to form a toner image. The above-mentioned developer layer is not specifically limited as long as it contains an electrostatic charge image developer of the present invention. The above-mentioned transfer step is a step in which the above-mentioned toner image is transferred on a transfer body.

In an image formation method of the present invention, an embodiment further comprising a cleaning step and a recycling step is preferable.

The above-mentioned cleaning step is a step in which an excess amount of the toner for developing an electrostatic charge image upon forming toner image is recollected. The above-mentioned recycling step is a step in which the collected toner in the above-mentioned cleaning step is transferred to the developer layer.

An image formation step of an embodiment comprising a cleaning step and a recycling step can be implemented in a toner recycle system type image formation device, such as a copying machine and a facsimile. It can be also applied to a recycle system of an embodiment where a toner is collected while developing without a cleaning step.

EXAMPLES

Example 1

First step

Preparation of dispersion (1)

| | |
|---|---|
| styrene | 370 g |
| n-butyl acrylate | 30 g |
| acrylic acid | 8 g |
| dodecane thiol | 24 g |
| carbon tetrabromide | 4 g |

The above-mentioned materials were mixed and dissolved and added to a solution prepared by dissolving 6 g of a nonionic surfactant (Nonipol 400, manufactured by Sanyo Chemical Industries, Ltd.) and 10 g of an anionic surfactant (Neogen SC, manufactured by Daiichi Kogyo Seiyaku Co., Ltd.) to 550 g of ion exchange water, dispersed, and emulsified in a flask. A solution prepared by dissolving 4 g of ammonium persulfate in 50 g of ion exchange water was added thereto while slowly mixing for 10 minutes. After substituting nitrogen, the content of the flask was heated in an oil bath to 70° C. while stirring, and left for emulsion polymerization for 5 hours.

As a result, a dispersion (1) of resin particles, having an average particle size of 155 nm, a glass transition point of 59° C., a weight-average molecular weight (Mw) of 12,000 was prepared.

Preparation of dispersion (2)

| | |
|---|---|
| styrene | 280 g |
| n-butyl acrylate | 120 g |
| acrylic acid | 8 g |

The above-mentioned materials were mixed and dissolved and added to a solution prepared by dissolving 6 g of a nonionic surfactant (Nonipol 400, manufactured by Sanyo Chemical Industries, Ltd.) and 12 g of an anionic surfactant (Neogen SC, manufactured by Daiichi Kogyo Seiyaku Co., Ltd.) to 550 g of ion exchange water, dispersed, and emulsified in a flask. A solution prepared by dissolving 3 g of ammonium persulfate in 50 g of ion exchange water was added thereto while slowly mixing for 10 minutes. After substituting nitrogen, the content of the flask was heated in an oil bath to 70° C. while stirring, and left for emulsion polymerization for 5 hours. As a result, dispersion (2) of resin particles, having an average particle size of 105 nm, a glass transition point of 53° C., Mw 550,000 was prepared.

Preparation of colorant dispersion (1)

| | |
|---|---|
| carbon black<br>Mogul L, manufactured by Cabot Co., Ltd.) | 50 g |
| nonionic surfactant<br>(Nonipol 400, manufactured by Sanyo Chemical Industries, Ltd.) | 5 g |
| ion exchanged water | 200 g |

The above-mentioned materials were mixed, dissolved and dispersed for 10 minutes by a homogenizer (Ultratalax T50, manufactured by IKA Co., Ltd.) to prepare colorant dispersion (1) of a colorant (carbon black), having an average particle size of 250 nm.

Preparation of a mold release agent dispersion (1)

| | |
|---|---|
| cationic surfactant<br>(Sanisol B50, manufactured by Kao Co., Ltd.) | 5 g |
| Ion exchanged water | 200 g |

The above-mentioned materials were heated to 95° C., dispersed by a homogenizer (Ultratalax T50, manufactured by IKA Co., Ltd.), and then applied with a dispersion treatment by a pressure discharge type homogenizer to prepare mold release agent dispersion (1) of a mold release agent, having an average particle size of 550 nm.

Preparation of aggregative particles

| | |
|---|---|
| dispersion (1) | 120 g |
| dispersion (2) | 80 g |
| colorant dispersion (1) | 30 g |
| mold release agent dispersion (1) | 40 g |
| cationic surfactant<br>(Sanisol B50, manufactured by Kao Co., Ltd.) | 1.5 g |

The above-mentioned material were mixed and dispersed in a round-type stainless steel flask by a homogenizer (Ultratalax T50, manufactured by IKA Co., Ltd.), and heated to 48° C. in an oil bath while stirring. After maintaining at 48° C. for 30 minutes, it was confirmed that aggregative particles (volume: 95 $cm^3$) having an average particle size of about 5 $\mu$m were formed by the observation with an optical microscope.

Second step

Preparation of adhered particles 60 g of dispersion (1) as a resin-containing fine particle dispersion was slowly added thereto. The volume of the resin particles contained in the above-mentioned dispersion (1) was 25 $cm^3$. The temperature of the heating oil bath was increased to 50° C. and maintained for 1 hour. It was confirmed that adhered particles having an average particle size of about 5.7 $\mu$m were formed by the observation with an optical microscope.

Third step 3 g of an anionic surfactant (Neogen SC, manufactured by Daiichi Kogyo Seiyaku Co., Ltd.) was added thereto, and the stainless steel flask was sealed tightly. While stirring with a magnetic seal, it was heated to 105° C. and maintained for 3 hours.

After cooling, the reaction product was filtered, washed sufficiently with ion exchange water, and dried to obtain a toner for developing an electrostatic charge image.

Evaluation

The average particle size of the obtained toner for developing an electrostatic charge image measured with a Coulter counter was 5.8 $\mu$m. The volume GSD, which is an index of the volume particle size distribution, was 1.24. The surface state was observed with an electron microscope. Exposure of a wax-like substance on the surface of the toner for developing an electrostatic charge image was slight, and separated wax-like substance was not observed.

Fixation of the toner for developing an electrostatic charge image was evaluated by rubbing with a cloth and modified V500 manufactured by Fuji Xerox, Co., Ltd. and a fastness tester. Sufficient fixing property was shown at a heat roller temperature of 130° C., and offset was not generated until 220° C.

The toner for developing an electrostatic charge image was mixed with a ferrite carrier having an average particle size of 50 μm, coated with polymethyl methacrylate to produce an electrostatic charge image developer. Continuous operation test was conducted with the electrostatic charge image developer. An stable image was obtained after copying 10,000 sheets without generation of filming on a light-sensitive element.

Comparative Example 1

| | |
|---|---|
| dispersion (1) | 180 g |
| dispersion (2) | 80 g |
| colorant dispersion (1) | 30 g |
| mold release agent dispersion (1) | 40 g |
| cationic surfactant (Sanisol B50, manufactured by Kao Co., Ltd.) | 1.5 g |

The above-mentioned material were mixed and dispersed in a round stainless steel flask by a homogenizer (Ultratalax T50, manufactured by IKA Co., Ltd.), and heated to 50° C. in an oil bath while stirring. After maintaining at 50° C. for 90 minutes, it was confirmed that adhered particles having an average particle size of about 5.8 μm were formed by the observation with an optical microscope.

3 g of an anionic surfactant (Neogen SC, manufactured by Daiichi Kobyo Seiyaku Co., Ltd.) was added thereto, and the stainless steel flask was sealed tightly. While stirring with a magnetic seal, it was heated to 105° C. and maintained for 3 hours.

After cooling, the reaction product was filtrated, and sufficiently washed with ion exchange water to obtain a toner for developing an electrostatic charge image.

Evaluation

The average particle size of the toner for developing an electrostatic charge image measured with a Coulter counter was 6.9 μm. The volume GSD, which is an index of the volume particle size distribution, was 1.32. The surface state was observed with an electron microscope. A lot of a wax-like substance was exposed on the surface of the toner for developing an electrostatic charge, and some separated wax-like substance was observed.

Fixation of the toner for developing an electrostatic charge image was evaluated by rubbing with a cloth and modified V500 manufactured by Fuji Xerox, Co., Ltd. and a fastness tester. Sufficient fixing property was shown at a heat roller temperature of 130° C., and offset was not generated until 230° C.

The toner for developing an electrostatic charge image was mixed with a ferrite carrier having an average particle size of 50 μm, coated with polymethyl methacrylate to produce an electrostatic charge image developer. Continuous operation test was conducted with the electrostatic charge image developer. Some dirt generation was observed after copying 10,000 sheets and slip-like dirt caused by filming on a light-sensitive element was also observed.

Example 2

In the process the same as Example 1 except that a mold release agent dispersion (1) of a mold release agent, having an average particle size of 1.2 μm was prepared without the dispersion treatment using the pressure-discharge-type homogenizer in Example 1, a toner for developing an electrostatic charge image having an average particle size of 6.0 μm was produced and evaluated as in Example 1.

The volume GSD of the obtained toner for developing an electrostatic charge image was 1.29. The surface state was observed with an electron microscope. Separated wax-like substance was not observed. Some wax-like substance was exposed on the surface of the toner surface, and the exposure amount was slightly uneven among the toner.

Fixation of the toner for developing an electrostatic charge image was evaluated by waste rubbing with a rag and modified V500 manufactured by Fuji Xerox, Co., Ltd. and a fastness tester. Sufficient fixing property was shown at a heat roller temperature of 130° C., and offset was not generated until 210° C.

The toner for developing an electrostatic charge image was mixed with a ferrite carrier having an average particle size of 50 μm, coated with polymethyl methacrylate to produce an electrostatic charge image developer. Continuous operation test was conducted with the electrostatic charge image developer. A stable image was obtained after copying 20,000 sheets and generation of filming on a light-sensitive element was not observed.

Example 3

First step

Preparation of dispersion (3)

| | |
|---|---|
| styrene | 320 g |
| n-butyl acrylate | 80 g |
| acrylic acid | 8 g |
| dodecane thiol | 12 g |
| carbon tetrabromide | 4 g |

The above-mentioned materials were mixed and dissolved, and added to a solution prepared by dissolving 6 g of a nonionic surfactant (Nonipol 400, manufactured by Sanyo Chemical Industries, Ltd.) and 10 g of an anionic surfactant (Neogen SC, manufactured by Daiichi Kogyo Seiyaku Co., Ltd.) to 550 g of ion exchange water, dispersed, and emulsified in a flask. A solution prepared by dissolving 4 g of ammonium persulfate in 50 g of ion exchange water was added thereto while slowly mixing for 10 minutes. After nitrogen was substituted, the content of the flask was heated by oil bath to 70° C. while stirring, and left for emulsion polymerization for 5 hours. A dispersion (3) of resin particles, having an average particle size of 170 nm, a glass transition point of 53° C., Mw of 22,000 was prepared.

Preparation of complex fine particles (resin/colorant) dispersion (1)

| | |
|---|---|
| polyester resin (bisphenol A - fumaric acid - propylene oxide adduct, Mw: 12,000, glass transition point temperature (Tg): 57° C.) | 50 g |
| methylene chloride | 100 g |
| phthalocyanine pigment (PV Fast Blue, manufactured by BASF Co., Ltd.) | 5 g |

The-above mentioned materials were mixed with a ball mill (UB32, manufactured by Yamato Kagaku Co., Ltd.) and dissolved. The mixture was dispersed in 150 g of pure water containing 10% of polyethylene glycol and 0.7% of an anionic surfactant (Neogen SC, manufactured by Daiichi Kogyo Seiyaku Co., Ltd.) while applying a strong shearing force with a homogenizer (Ultratalax T50, manufactured by IKA Co., Ltd.), heated to 60° C. and maintained for 1 hour to obtain complex fine particles (resin/colorant) dispersion (1) of complex fine particles (polyester resin/cyan pigment), having an average particle size of 850 nm.

Preparation of colorant dispersion (2)

| | |
|---|---|
| phthalocyanine pigment (PV Fast Blue, manufactured by BASF Co., Ltd.) | 100 g |
| nonionic surfactant (Nonipol 400, manufactured by Sanyo Chemical Industries, Ltd.) | 5 g |
| ion exchanged water | 200 g |

The above-mentioned materials were mixed, dissolved, dispersed for 10 minutes by a rotor-stator-type homogenizer (Ultratalax, manufactured by IKA Co., Ltd.), and further dispersed for 5 minutes by a supersonic homogenizer to prepare a colorant dispersion (2) of a colorant, having an average particle size of 150 nm.

Preparation of inorganic fine particle dispersion (1)

| | |
|---|---|
| silica (A300, manufactured by Nihon Aerosil Co., Ltd.) | 20 g |
| cationic surfactant (Sanisol B50, manufactured by Kao Co., Ltd.) | 5 g |
| ion exchanged water | 200 g |

The above-mentioned materials were mixed, dissolved and dispersed for 10 minutes by a homogenizer (Ultratalax, manufactured by IKA Co., Ltd.) to prepare an inorganic fine particle dispersion (1) of inorganic fine particles, having an average particle size of 70 nm.

Preparation of aggregative particles

| | |
|---|---|
| dispersion (3) | 200 g |
| colorant dispersion (2) | 15 g |
| cationic surfactant (Sanisol B50, manufactured by Kao Co., Ltd.) | 2 g |

The above-mentioned material were mixed and dispersed in a round type stainless steel flask by a homogenizer (Ultratalax T50, manufactured by IKA Co., Ltd.), and heated to 48° C. in an oil bath while stirring. After maintaining at 48° C. for 30 minutes, it was confirmed that aggregative particles (volume: about 90 $cm^3$) having an average particle size of about 5.2 $\mu$m were formed by the observation with an optical microscope.

Second step

Preparation of adhered particles 50 g of the complex fine particle (resin/colorant) dispersion (1) was slowly added thereto. The temperature of the oil bath was increased to 50° C. and maintained for 30 minutes. The volume of the complex fine particles contained in the above-mentioned complex fine particle dispersion (1) was about 15 $cm^3$. It was confirmed that adhered particles having an average particle size of about 5.8 $\mu$m were formed by the observation with an optical microscope.

10 g of the inorganic fine particle dispersion (1) was further added thereto. The temperature was further increased to 51.5° C. and maintained for 1 hour. It was observed that although the average particle size change was hardly found but the added silica was substantially adhered on the surface of the aggregative particles according to observation with an optical microscope.

Third step 2 g of an anionic surfactant (Neogen SC, manufactured by Daiichi Kobyo Seiyaku Co., Ltd.) was added thereto, and the stainless steel flask was sealed tightly. While stirring with a magnetic seal, it was heated to 105° C. and maintained for 3 hours. After cooling, the reaction product was filtrated, and washed sufficiently with ion exchange water to obtain a toner for developing an electrostatic charge image.

Evaluation

The average particle size of the obtained toner for developing an electrostatic charge image measured with a Coulter counter was 5.8 $\mu$m. The volume GSD, which is an index of the volume particle size distribution, was 1.23. The surface state of the obtained toner for developing an electrostatic charge image was observed with an electron microscope. Silica was homogeneously adhered on the particle surface and fixed to the fused resin. The section of the toner particles was observed with a transmission electron microscope. A cyan pigment on the surface layer of the toner for developing an electrostatic charge image was hardly exposed, and coated substantially homogeneously in the resin-containing fine particle (polyester resin/pigment) layer and the inorganic fine particle (silica) layer.

The obtained toner for developing an electrostatic charge image was mixed with a ferrite carrier having an average particle size of 50 $\mu$m, coated with polymethyl methacrylate to produce an electrostatic charge image developer. Continuous operation test was conducted with the electrostatic charge image developer. An stable image was obtained after copying 20,000 sheets without generation. of filming on a light-sensitive element.

Image quality test was conducted with modified Acolor, manufactured by Fuji Xerox Co., Ltd. The flowability of the obtained toner for developing an electrostatic charge image was found to be excellent and a vivid cyan image with a high glossiness was obtained.

Example 4

First step

Preparation of mold release agent dispersion (2)

| | |
|---|---|
| Fischer Tropsch wax (melting point: 95° C.; manufactured by Nihon Seirou Co., Ltd.) | 50 g |
| cationic surfactant (Sanisol B50, manufactured by Kao Co., Ltd.) | 6 g |
| Ion exchanged water | 200 g |

The above-mentioned materials were heated to 105° C., coarsely dispersed by a turbo-fin-type impeller, and then applied with a dispersion treatment by a pressure discharge type homogenizer to prepare a mold release agent dispersion (2) of mold release agent fine particles, having an average particle size of 350 nm.

Preparation of aggregative particles

| | |
|---|---|
| dispersion (1) | 120 g |
| dispersion (2) | 80 g |
| colorant dispersion (1) | 30 g |
| cationic surfactant (Sanisol B50, manufactured by Kao Co., Ltd.) | 1.2 g |

The above-mentioned material were mixed and dispersed in a round type stainless steel flask by a homogenizer (Ultratalax T50, manufactured by IKA Co., Ltd.), and heated to 48° C. in an oil bath while stirring. After maintaining at 48° C. for 30 minutes, it was confirmed that aggregative particles (volume: 85 $cm^3$) having an average particle size of about 4.9 μm were formed according to observation with an optical microscope.

Second step

Preparation of adhered particles

A total of 40 g of the mold release agent fine particle dispersion (2) divided 4 times was added, maintained at 50° C. for 30 minutes. 50 g of the dispersion (1) as a resin-containing fine particle dispersion was continuously and slowly added, and the temperature of the oil bath was increased to 52° C. and maintained for 1 hour. The volume of the mold release agent fine particles contained in the above-mentioned mold release agent fine particle dispersion (2) was about 7 $cm^3$. It was confirmed that adhered particles having an average particle size of about 5.9 μm were formed according to observation with an optical microscope.

Third step

Thereafter, 2 g of an anionic surfactant (Neogen SC, manufactured by Daiichi Kobyo Seiyaku Co., Ltd.) was added thereto, and the stainless steel flask was sealed tightly. While stirring with a magnetic seal, it was heated to 105° C. and maintained for 3 hours. After cooling, the reaction product was filtered, and washed sufficiently with ion exchange water, to obtain a toner for developing an electrostatic charge image.

Evaluation

The average particle size of the obtained toner for developing an electrostatic charge image measured with a Coulter counter was 6.2 μm. The volume GSD, which is an index of the volume particle size distribution, was 1.23. The section of the obtained toner particles was observed with a transmission electron microscope. It was observed that core particles comprising aggregative pigment and resin in the center were surrounded by a mold release agent fine particle (wax) layer, and the surface thereof was further coated by a resin-containing fine particle (resin particle) layer.

An image was formed and fixed by a modified V500, manufactured by Fuji Xerox, Co., Ltd., and fixation was evaluated by rubbing with a cloth and fastness tester. Sufficient fixing property was shown at a heat roll temperature of 135° C., and offset was not generated even at 240° C.

The obtained toner for developing an electrostatic charge image was mixed with a ferrite carrier having an average particle size of 50 μm, coated with polymethyl methacrylate to produce an electrostatic charge image developer. Continuous operation test was conducted with the electrostatic charge image developer. An stable image was obtained after copying 20,000 sheets without generation of filming on a light-sensitive element.

Example 5

First step

Preparation of a dispersion (4)

| | |
|---|---|
| polyester resin (bisphenol A - fumaric acid - propylene oxide adduct, Mw: 12,000; glass transition point temperature (Tg): 57° C.) | 50 g |
| methylene chloride | 100 g |

The-above mentioned materials were mixed with a ball mill and dissolved. The mixture was dispersed in 150 g of pure water containing 10% of polyethylene glycol and 0.7% of a cationic surfactant (Sanisol B50, manufactured by Kao Co., Ltd.) while applying a strong shearing force with a homogenizer (Ultratalax, manufactured by IKA Co., Ltd.), heated to 60° C. and maintained for 1 hour to obtain a dispersion (4) of resin fine particles, having an average particle size of 850 nm.

Preparation of colorant dispersion (3)

| | |
|---|---|
| phthalocyanine pigment (PV Fast Blue, manufactured by BASF Co., Ltd.) | 100 g |
| anionic surfactant (Neogen SC, manufactured by Daiichi Kogyo Seiyaku Co., Ltd.) | 5 g |
| ion exchange water | 200 g |

The above-mentioned materials were mixed, dissolved, dispersed for 10 minutes by a rotor stator type homogenizer (Ultratalax, manufactured by IKA Co., Ltd.), and further dispersed for 5 minutes by a supersonic homogenizer to prepare a colorant dispersion (3) of a colorant, having an average particle size of 100 nm.

Preparation of aggregative particles

| | |
|---|---|
| dispersion (3) | 150 g |
| dispersion (4) | 50 g |
| colorant dispersion (2) | 5 g |
| cationic surfactant (Sanisol B50, manufactured by Kao Co., Ltd.) | 2 g |

The above-mentioned material were mixed and dispersed in a round type stainless steel flask by a homogenizer (Ultratalax T50, manufactured by IKA Co., Ltd.), and heated to 48° C. by an oil bath while stirring. After maintaining at 48° C. for 30 minutes, it was confirmed that aggregative particles (volume: about 80 $cm^3$) having an average particle size of about 5.2 μm were formed according to observation with an optical microscope.

Second step

Preparation of adhered particles 10 g of the colorant dispersion (2) as a colorant fine particle dispersion was slowly added thereto. The temperature of the heating oil bath was increased to 50° C. and maintained for 30 minutes. The volume of the colorant fine particles contained in the above-mentioned colorant fine particle dispersion (2) was about 3 $cm^3$. It was confirmed that adhered particles having an average particle size of about 6.0 μm were formed according to observation with an optical microscope.

50 g of the dispersion (3) as a resin-containing fine particle dispersion was further added thereto. The temperature was further increased to 52° C. and maintained for 1 hour.

Third step 2 g of an anionic surfactant (Neogen SC, manufactured by Daiichi Kobyo Seiyaku Co., Ltd.) was added thereto, and the stainless steel flask was sealed tightly. While stirring with a magnetic seal, it was heated to 110° C. and maintained for 3 hours. After cooling, the reaction product was filtered, and washed sufficiently with ion exchange water to obtain a toner for developing an electrostatic charge image.

Evaluation

The average particle size of the obtained toner for developing an electrostatic charge image measured with a Coulter counter was 6.1 μm. The volume GSD, which is an index of the volume particle size distribution was 1.24. The section of the obtained toner particles was observed with a transmission electron microscope. It was observed that cyan pigment was hardly exposed on the surface layer of the particles, a layer of high density colorant fine particles existed in the vicinity of the surface layer of the particles, and the surface thereof was further coated by a layer of resin particles substantially homogeneously.

The obtained toner for developing an electrostatic charge image was mixed with a ferrite carrier having an average particle size of 50 μm, coated with polymethyl methacrylate to produce an electrostatic charge image developer. Continuous operation test was conducted with the electrostatic charge image developer. An stable image was obtained after copying 20,000 sheets without generation of filming on a light-sensitive element.

After applying 0.5% of hydrophobic silica (R812, manufactured by Nihon Aerosil Co., Ltd.) with a shearing force on the particle surface of the obtained toner for developing an electrostatic charge image as an ordinary toner, an image quality test was conducted by a modified Acolor, manufactured by Fuji Xerox, Co., Ltd., to be found that a vivid cyan image with a high glossiness was obtained, and image maintenance ability in a high humidity condition was also good.

Example 6

With the electrostatic charge image developer obtained in Example 1, and a developer produced by modifying the developer used in Example 1 to a toner recycle system type where toner collected from the cleaner portion is returned to the developer, a stable image was obtained after copying 10,000 sheets and generation of filming on a light-sensitive element was not observed.

It was learned that an electrostatic charge image developer of the present invention containing a toner for developing an electrostatic charge image of the present invention has an excellent cleaning property, and can be preferably applied to image formation not only in a cleanerless system, but also in a toner recycle system.

What is claimed is that:

1. A production method of a toner for developing an electrostatic charge image comprising: a first step of forming aggregative particles in a first dispersion including at least dispersed resin particles to prepare an aggregative particle dispersion, a second step of adding a fine particle dispersion containing dispersed fine particles into said aggregative particle dispersion and mixing therewith to form adhered particles having said fine particles adhering to said aggregative particles, and a third step of heating said adhered particles to be fused.

2. The production method of a toner for developing an electrostatic charge image according to claim 1, wherein the first dispersion further comprises a dispersed colorant.

3. The production method of a toner for developing an electrostatic charge image according to claim 1, wherein the fine particles are resin-containing fine particles.

4. The production method of a toner for developing an electrostatic charge image according to claim 1, wherein the fine particles are inorganic fine particles.

5. The production method of a toner for developing an electrostatic charge image according to claim 1, wherein the fine particles are colorant fine particles.

6. The production method of a toner for developing an electrostatic charge image according to claim 1, wherein the fine particles are mold release agent fine particles.

7. The production method of a toner for developing an electrostatic charge image according to claim 1, wherein an average particle size of the resin particles is 1 μm or less.

8. The production method of a toner for developing an electrostatic charge image according to claim 1, wherein an average particle size of the fine particles is 1 μm or less.

9. The production method of a toner for developing an electrostatic charge image according to claim 1, wherein the fine particles are 50% or less by volume, based on a volume of toner particles for developing an electrostatic charge image.

10. The production method of a toner for developing an electrostatic charge image according to claim 1, wherein the fine particle dispersion in the second step is divided into two or more, and then added and mixed.

11. The production method of a toner for developing an electrostatic charge image according to claim 1, wherein the second step is conducted repeatedly.

12. The production method of a toner for developing an electrostatic charge image according to claim 1, wherein the second step is a step of adding said fine particle dispersion including dispersed fine particles of a mold release agent into said aggregative particle dispersion and mixing therewith to form first adhered particles having said dispersed fine particles of mold release agent adhering to said aggregative particles, thereafter adding a resin-containing fine particle dispersion to said first-adhered-particles-containing dispersion and mixing to form second adhered particles having the resin-containing particles adhering to said first adhered particles.

13. The production method of a toner for developing an electrostatic charge image according to claim 1, wherein the second step is a step of adding and said fine particle dispersion including dispersed fine particles of colorant into said aggregative particle dispersion to form first adhered particles having said dispersed fine particles of colorant adhering to said aggregative particle, thereafter adding a resin-containing fine particle dispersion to said first-adhered-particles-containing dispersion and mixing to form second adhered particles having the resin-containing particles adhering to said first adhered particles.

14. The production method of a toner for developing an electrostatic charge image according to claim 1, wherein the second step is a step of adding said fine particle dispersion including resin-containing fine particles into said aggregative particle dispersion and mixing therewith to form first adhered particles having said resin-containing fine particles adhering to said aggregative particles, thereafter adding an inorganic fine particle dispersion to said first-adhered-particles-containing dispersion and mixing to form second adhered particles having the inorganic fine particles adhering to said first adhered particles.

15. The production method of a toner for developing an electrostatic charge image according to claim 3, wherein the resin-containing fine particles are complex fine particles comprising a resin and a colorant.

16. The production method of a toner for developing an electrostatic charge image according to claim 12, wherein heating of the third step is conducted at the temperature of the glass transition point of the resin or lower after adding and mixing.

17. A toner for developing an electrostatic charge image obtained by the production method according to claim 1.

18. An image formation method comprising the steps of: forming an electrostatic latent image on an electrostatic latent image holding member, developing said electrostatic latent image by using a developer layer on a developer carrying member to form a toner image, and transferring said toner image on a transfer body, wherein said developer layer comprises the toner according to claim 17.

19. The image formation method according to claim 18, wherein the developer layer further comprises a carrier.

20. The image formation method according to claim 18, further comprising a cleaning step in which an excess amount of said toner for developing an electrostatic charge image is collected during forming said toner image and a recycling step where the toner for developing an electrostatic charge image collected in said cleaning step is transferred to the developer layer.

21. The production method of a toner for developing an electrostatic charge image according to claim 1, wherein a medium of said first dispersion, a medium of said aggregative particle dispersion and a medium of said fine particle dispersion each comprises water.

22. The production method of a toner for developing an electrostatic charge image according to claim 1, wherein an amount of the resin particles in said first dispersion is between 5% and 60% by weight; and an amount of the fine particles in said fine particle dispersion is between 5% and 60% by weight.

* * * * *